US007708937B2

(12) United States Patent
Meng et al.

(10) Patent No.: US 7,708,937 B2
(45) Date of Patent: May 4, 2010

(54) HIGH-STRENGTH, HIGH-TOUGHNESS, WELDABLE AND DEFORMABLE RARE EARTH MAGNESIUM ALLOY

(75) Inventors: Jian Meng, Jilin (CN); Daqing Fang, Jilin (CN); Deping Zhang, Jilin (CN); Dingxiang Tang, Jilin (CN); Huayi Lu, Jilin (CN); Lianshan Zhao, Jilin (CN); Wei Sun, Jilin (CN); Xin Qiu, Jilin (CN); Hongjie Zhang, Jilin (CN)

(73) Assignee: Changchun Institute of Applied Chemistry Chinese Academy of Sciences, Changchun, Jilin Province (CN)

( * ) Notice: Subject to any disclaimer, the term of this patent is extended or adjusted under 35 U.S.C. 154(b) by 0 days.

(21) Appl. No.: 12/105,165

(22) Filed: Apr. 17, 2008

(65) Prior Publication Data

US 2009/0263271 A1 Oct. 22, 2009

(51) Int. Cl.
*C22C 23/06* (2006.01)
*C22C 23/00* (2006.01)

(52) U.S. Cl. ..... 420/406; 148/420

(58) Field of Classification Search ..... 420/406; 148/420

See application file for complete search history.

(56) References Cited

U.S. PATENT DOCUMENTS 3,419,385 A * 12/1968 Foerster et al. ..... 420/404
2007/0227629 A1 * 10/2007 Gerold et al. ..... 148/420

* cited by examiner

*Primary Examiner*—Roy King
*Assistant Examiner*—Caitlin Fogarty
(74) *Attorney, Agent, or Firm*—Knobbe, Martens, Olson & Bear, LLP

(57) ABSTRACT

A high-strength, high-toughness, weldable and deformable rare earth magnesium alloy comprised of 0.7~1.7% of Ym, 5.5~6.4% of Zn, 0.45~0.8% of Zr, 0.02% or less of the total amount of impurity elements of Si, Fe, Cu and Ni, and the remainder of Mg, based on the total weight of the alloy. During smelting, Y, Ho, Er, Gd and Zr are added in a manner of Mg—Y-rich, Mg—Zr intermediate alloys into a magnesium melt; Zn is added in a manner of pure Zn, and at 690~720° C., a round bar was cast by a semi-continuous casting or a water cooled mould, then an extrusion molding was performed at 380~410° C. after cutting. Before the extrusion, the alloy is treated by the solid-solution treatment at 480~510° C. for 2~3 hours, however, the alloy can also be extrusion molded directly without the solid-solution treatment. After the extrusion molding, this alloy has a strength of 340 MPa or more and a percentage elongation of 14% or more at room temperature and is a high-strength, high-toughness, weldable and deformable rare earth magnesium alloy.

2 Claims, No Drawings

HIGH-STRENGTH, HIGH-TOUGHNESS, WELDABLE AND DEFORMABLE RARE EARTH MAGNESIUM ALLOY

BACKGROUND OF THE INVENTION

1. Field of the Invention

The present invention relates to a high-strength, high-toughness, weldable and deformable rare earth magnesium alloy.

2. Description of the Related Art

Comparing with the mature industries of steel, aluminum, copper and the like, the proportion of deformable magnesium alloy in magnesium alloy industry is too low, only less than 10%, due to the following reasons: a) the technology of the magnesium alloy industry is still immature; b) the magnesium industry still has a very large technology space and a profit space.

In deformable magnesium alloys, the common alloy series are Mg—Mn, Mg—Al and Mg—Zn—Zr series. Trademark MB1, namely, Mg—Mn binary alloy, has a good corrosion resisting property; however, its strength is not high. MB8 developed for overcoming the drawback thereof comprises rare earth cerium which has the function of fining crystal grains and increasing strength. The strength of an alloy can be increased again by further increasing the content of Ce, and therefore, MB14 was developed as well. MB2, namely, AZ31 of US, belongs to Mg—Al series and is a deformable alloy with a wide application. The subsequent MB3 to MB7 are all developed on the basis of MB2 and comprise more Al or Zn. Although the strengths of MB3 to MB7 are increased, the plastic properties decreased largely, and the present research indicates that appropriate amount of rare earths can increase the overall performance. Corresponding to ZK60 of US, MB15 belongs to Mg—Zn—Zr series and is a high-strength alloy which can be age strengthened. The content of Zr is relatively stable, generally 0.6~0.8%, however, when Zn excesses 4.5%, the plastic property will decrease largely. In order to obtain the overall performance, MB21 is adopted in China (the content of Zn is low). In this way, Mg—Zn—Zr series is separated into the two types of high zinc alloys and low zinc alloys, wherein MB21, MB22 belong to low zinc alloys, while MB15, MB25 belong to high zinc alloy. MB25 further comprises rare earth Y as compared with MB 15.

From what described above, it can be seen that addition of rare earths on the basis of primary alloy series is an effective way for increasing performance, and the rare earths are also necessary ingredients for achieving a good high temperature resistance performance. However, by various strengthening manner, the performance of Mg—Zn—Zr series excels the other two series.

It is well known that magnesium alloy is a light metal material and the rare earth elements have specific effects in the aspects of improving the strength, heat resistance and the like of the traditional magnesium alloys. However, the addition of rare earths, for example, Nd, Y, La, is always performed in a manner of a single pure rare earth in many scientific research departments and producing factories except that Ce is always added in a manner of cerium-rich mixed rare earth.

SUMMARY OF THE INVENTION

An object of this invention is to provide a high-strength, high-toughness, weldable and deformable rare earth magnesium alloy. By adding yttrium-rich rare earths (hereinafter referred to as Ym) to increase the strength and the percentage elongation of the alloy, and by appropriate smelting, thermal treating process condition and processing means, a high-strength, high-toughness, weldable and deformable rare earth magnesium alloy having superior mechanical performances and cost advantage to the traditional MB25 magnesium alloy was obtained.

Unless otherwise indicated, the term "yttrium-rich rare earth" (i.e., Ym) means a rare earth composition comprising no less than 75 wt % Y. According to some embodiments of the present invention, the Ym further comprises at least one, preferably all, of Er, Ho and Gd. There is no limitation to the amounts of each of Er, Ho and Gd, but the total amount of them is no higher than 25% by weight of the rare earth composition.

Unless otherwise indicated, the values represented by percentage, parts, and % are based on weight.

The present invention provides a high-strength, high-toughness, weldable and deformable rare earth magnesium alloy of this invention comprised of:

0.7~1.7% of Ym, 5.5~6.4% of Zn, 0.45~0.8% of Zr, 0.02% or less of the total amount of Si, Fe, Cu and Ni as impurity elements, and the remainder of Mg.

Without any theory bounded, we believe that the surprising technical effects achieved by adding Ym instead of pure Y may be contributed by the interaction of a certain amount of other are earth elements such as Ho, Er and the like contained in the Y-rich rare earths. For example, Er has a great effect on improving ductility.

The steps and conditions for the preparation method of a high-strength, high-toughness, weldable and deformable rare earth magnesium alloy are described below.

As examples, two methods for preparing the high-strength, high-toughness, weldable and deformable rare earth magnesium alloy according to the present invention are illustrated as follows:

(1) Firstly, Mg, Zn, Mg—Zr intermediate alloy and Mg—Ym intermediate alloy (Ym, for example, contains Y, Er, Ho and Gd) are pre-heated to 200~280° C., respectively. Then, Mg is placed into a crucible containing a melted flux to be melted. After Mg has been melted, Zn is added, and when the temperature of the magnesium liquid reaches 720~750° C., Mg—Ym intermediate alloy is added. When Mg—Ym intermediate alloy has been melted and the temperature of the magnesium liquid rises back to 750~780° C., Mg—Zr intermediate alloy is added and then a flux (for example, No. 6 flux) is added. After refining for 15~20 min, settling for 40~50 min. A casting is performed when the temperature drops to 690~720° C. and a high-strength, high-toughness, weldable and deformable rare earth magnesium alloy is obtained.

(2) Firstly, Mg, Zn, Mg—Zr intermediate alloy and Mg—Ym intermediate alloy (containing Y, Er, Ho and Gd) are pre-heated to 200~280° C., respectively. Then, Mg is placed into a melting oven protected by a gas of $SF_6/CO_2$ to be melted. After Mg has been melted, Zn is added, and when the temperature of the magnesium liquid reaches 720~750° C., Mg—Ym intermediate alloy is added. When Mg—Ym intermediate alloy has been melted and the temperature of the magnesium liquid rises back to 750~780° C., Mg—Zr intermediate alloy is added and the mixture is stirred. After slag is removed, refining for 5~10 min while blowing argon and then settling for 30~45 min. A casting is performed when the temperature falls to 690~720° C. and a high-strength, high-toughness, weldable and deformable rare earth magnesium alloy is obtained.

As examples of methods for said casting processes of the above two methods for preparing a high-strength, high-toughness, weldable and deformable rare earth magnesium alloy, the following two methods can be illustrated: a) casting in a water cooled mould to produce a round bar; and b) casting using a semi-continuous casting method. The castings produced by the two casting processes have crystal grains finer than those of the castings produced by traditional casting processes and have an increased strength.

According to some embodiments of the present invention, the following substantial features and prominent technical progress can be illustrated:

1. Using Mg—Ym intermediate alloy (containing Gd, Er, Ho and the like) instead of Mg—Y intermediate alloy. The mechanical performances of tensile strength, percentage elongation and the like of an alloy are increased by the interactions among the composite rare earth elements and the interactions among the rare earth elements and magnesium and zinc. The addition of intermediate alloy can also reduce the smelting temperature of an alloy and can eliminate the inclusions and gases, and make it easier to form an alloy with Mg.
2. By casting a bar using a water cooled mould or by the semi-continuous casting method, the crystal grains can be fined dramatically and the alloy is apt for large-scale industrial production.
3. The extrusion pressing temperature can be reduced by using a solid-solution treating process before the extrusion pressing treatment. If extrusion pressing without the solid-solution treating process, the extrusion pressure temperature should be elevated. Both of the two processes (with or without the solid-solution treating process) can be selected according to the performance of the mould.

DETAILED DESCRIPTION OF THE PREFERRED EMBODIMENT

In the following examples, the composition of Y-rich rare earth is as follows (based on the total weight of the Y-rich rare earth):

| Element | La | Nd | Dy | Gd | Ho | Er | Tm | Yb | Lu | Y |
|---|---|---|---|---|---|---|---|---|---|---|
| Composition, wt % | 0.11 | 0.16 | 0.11 | 1.46 | 6.30 | 10.22 | 1.45 | 0.18 | 0.55 | 78.75 |

Herein, the composition of No. 6 flux is as follows (based on the total weight of the No. 6 flux):

| | main components, wt % | | | | impurities, wt % | | | |
|---|---|---|---|---|---|---|---|---|
| Tradename | KCl | $BaCl_2$ | $CaF_2$ | $CaCl_2$ | NaCl + $CaCl_2$ | insolubles | MgO | $H_2O$ |
| RJ-6 | 54-56 | 14-16 | 1.5-2.5 | 27-29 | 8 | 1.5 | 1.5 | 2 |

EXAMPLE 1

The composition of an alloy (percentage by weight) are as follows: 0.9% of Y-rich rare earth (the content of Y is no less than 75%), 5.5~6.4% of Zn, 0.45~0.8% of Zr, 0.02% or less of the total amount of impurity elements of Si, Fe, Cu and Ni, and the remainder of Mg.

The melt casting process for preparing an alloy is following: Firstly, Mg, Zn, Mg—Zr intermediate alloy and Mg—Ym intermediate alloy (the Ym intermediate alloy contains Y, Er, Ho and Gd) according to the composition of the alloy described above were pre-heated to 200~280° C. Then, Mg was placed into a melting oven protected by a gas of $SF_6/CO_2$ to be melted. After Mg has been melted, Zn was added, and when the temperature of the magnesium liquid reached 720~750° C., Mg—Ym intermediate alloy was added. When Mg—Ym intermediate alloy has been melted and the temperature of the magnesium liquid rose back to 750~780° C., Mg—Zr intermediate alloy was added and the mixture was stirred. After slag was removed, refining for 5~10 min with blowing argon and settling for 30~45 min. When the temperature fell to 690~720° C., a round bar was cast using a water cooled mould. The processing process for an alloy is as follows: the alloy obtained was treated by a solid-solution treatment under a temperature of 480~510° C. for 2~3 hours. After cutting, an extrusion molding was performed at 330~380° C. to obtain a high-strength, high-toughness, weldable and deformable rare earth magnesium alloy.

The high-strength, high-toughness, weldable and deformable rare earth magnesium alloy obtained in the present example have the mechanical performances at room temperature as follows:

Tensile strength: 349 MPa

Percentage elongation: 14.2%

EXAMPLE 2

The composition of an alloy (percentage by weight) are as follows: 1.0% of Y-rich rare earth, 6.1% of Zn, 0.6% of Zr, less than 0.02% of the total amount of Si, Fe, Cu and Ni as impurity elements, and the remainder of Mg.

The melt casting process for preparing an alloy is as follows: Firstly, Mg, Zn, Mg—Zr intermediate alloy and Mg—Ym intermediate alloy (containing Y, Er, Ho and Gd) according to the composition described above were pre-heated to 200~280° C., respectively. Then, Mg was placed into a melting oven protected by a gas of $SF_6/CO_2$ to be melted. After Mg had been melted, Zn was added, and when the temperature of the magnesium liquid reached 720~750° C., adding Mg—Ym intermediate alloy. After Mg—Ym intermediate alloy melted and when the temperature of the magnesium liquid rose back to 750~780° C., adding Mg—Zr intermediate alloy and stirring. After slag removing, refining for 5~10 min with blowing argon and settling for 30~45 min. When the temperature fell to 690~720° C., a round bar was cast using a water cooled mould. The processing process for an allow is following: the alloy obtained was extrusion molded at 380~410° C. after cutting to obtain a high-strength, high-toughness, weldable and deformable rare earth magnesium alloy.

The high-strength, high-toughness, weldable and deformable rare earth magnesium alloy obtained in the present example have the mechanical performances at room temperature as follows:

Tensile strength: 352 MPa

Percentage elongation: 14.2%

EXAMPLE 3

The composition of an alloy (percentage by weight) are as follows: 0.9% of Y-rich rare earth (the content of Y is above 75%), 5.8% of Zn, 0.7% of Zr, less than 0.02% of the total amount of Si, Fe, Cu and Ni as impurity elements, and the remainder of Mg.

The melt casting process for preparing an alloy is following: Firstly, Mg, Zn, Mg—Zr intermediate alloy and Mg—Ym intermediate (containing Y, Er, Ho and Gd) according to the composition described above were pre-heated to 200~280° C. Then, Mg was placed into a melting oven protected by a gas of $SF_6/CO_2$ to be melted. After Mg had been melted, Zn was added, and when the temperature of the magnesium liquid reached 720~750° C., adding Mg—Ym intermediate alloy. When Mg—Ym intermediate alloy had been melted and the temperature of the magnesium liquid rose back to 750~780° C., adding Mg—Zr intermediate alloy and stirring. After slag was removed, refining for 5~10 min with blowing argon and settling for 30~45 min. When the temperature fell to 690~720° C., a round bar was cast using a semi-continuous casting method. The processing process for an alloy is following: the alloy obtained was treated by a solid-solution treatment under a temperature of 480~510° C. for 2~3 hours. After cutting, an extrusion molding was performed at 330~380° C. to obtain a high-strength, high-toughness, weldable and deformable rare earth magnesium alloy.

The high-strength, high-toughness, weldable and deformable rare earth magnesium alloy contained in the present example has the mechanical performances at room temperature as follows:

Tensile strength: 368 MPa

Percentage elongation: 18:3%

EXAMPLE 4

The composition of an alloy (percentage by weight) are as follows: 0.9% of Y-rich rare earth (the content of Y is above 75%), 6.4% of Zn, 0.5% of Zr, less than 0.02% of the total amount of impurity elements of Si, Fe, Cu and Ni, and the remainder of Mg.

The melt casting process for preparing an alloy is following: Firstly, Mg, Zn, Mg—Zr intermediate alloy and Mg—Ym intermediate alloy (containing Y, Er, Ho and Gd) according to the composition described above were pre-heated to 200~280° C., respectively. Then, Mg was placed into a melting oven protected by a gas of $SF_6/CO_2$ to be melted. After Mg had been melted, Zn was added, and when the temperature of the magnesium liquid reached 720~750° C., adding Mg—Ym intermediate alloy. After Mg—Ym intermediate alloy has been melted and the temperature of the magnesium liquid rose back to 750~780° C., adding Mg—Zr intermediate alloy and stirring. After slag was removed, refining for 5~10 min with blowing argon and settling for 30~45 min. When the temperature fell to 690~720° C., a round bar was cast using a semi-continuous casting method. The processing process for an alloy is following: the alloy obtained was extrusion molded at 380~410° C. after cutting to obtain a high-strength, high-toughness, weldable and deformable rare earth magnesium alloy.

The high-strength, high-toughness, weldable and deformable rare earth magnesium alloy obtained in the present example has the mechanical performances at room temperature as follows:

Tensile strength: 362 MPa

Percentage elongation: 17.9%

EXAMPLE 5

The composition of an alloy (percentage by weight) are as follows: 1.6% of Y-rich rare earth (the content of Y is above 75%), 5.5% of Zn, 0.6% of Zr, less than 0.02% of the total amount of Si, Fe, Cu and Ni as impurity elements, and the remainder of Mg.

The melt casting process for preparing an alloy was following: Firstly, Mg, Zn, Mg—Zr intermediate alloy and After Mg—Ym intermediate alloy (containing Y, Er, Ho and Gd) according to the composition described above were pre-heated to 200~280° C. Then, Mg was placed into a crucible containing a melted flux to be melted. After Mg has been melted, Zn was added, and when the temperature of the magnesium liquid reached 720~750° C., Mg—Ym intermediate alloy was added. When Mg—Ym intermediate alloy has been melted and the temperature of the magnesium liquid rose back to 750~780°, adding Mg—Zr intermediate alloy and adding No. 6 flux. After refining for 15~20 min, settling for 40~50 min. When the temperature fell to 690~720° C., a round bar was cast using a water cooled mould. The processing process for an alloy was following: the alloy obtained was treated by a solid-solution treatment under a temperature of 480~510° C. for 2~3 hours. After cutting, an extrusion molding was performed at 330~380° C. to obtain a high-strength, high-toughness, weldable and deformable rare earth magnesium alloy.

The high-strength, high-toughness, weldable and deformable rare earth magnesium alloy obtained in the present example has the mechanical performances at room temperature as follows:

Tensile strength: 348 MPa

Percentage elongation: 15.2%

EXAMPLE 6

The composition of an alloy (percentage by weight) are as follows: 0.7% of Y-rich rare earth (the content of Y is above 75%), 6.4% of Zn, 0.7% of Zr, less than 0.02% of the total amount of Si, Fe, Cu and Ni as impurity elements, and the remainder of Mg.

The melt casting process for preparing an alloy was following: Firstly, Mg, Zn, Mg—Zr intermediate alloy and Mg—Ym intermediate alloy (containing Y, Er, Ho and Gd) according to the composition described above were pre-heated to 200~280° C., respectively. Then, Mg was placed into a crucible containing a melted flux to be melted. After Mg has been melted, Zn was added, and when the temperature of the magnesium liquid reached 720~750° C., Mg—Ym intermediate alloy was added. When Mg—Ym intermediate alloy has been melted and the temperature of the magnesium liquid rose back to 750~780° C., adding Mg—Zr intermediate alloy and adding No. 6 flux. After refining for 15~20 min, settling for 40~50 min. When the temperature fell to 690~720° C., a round bar was cast using a water cooled mould. The processing process for an alloy was following: the alloy obtained was extrusion molded at 380~410° C. after cutting to obtain a high-strength, high-toughness, weldable and deformable rare earth magnesium alloy.

The high-strength, high-toughness, weldable and deformable rare earth magnesium alloy obtained in the present example has the mechanical performances at room temperature as follows:

Tensile strength: 360 MPa

Percentage elongation: 17.5%

EXAMPLE 7

The composition of an alloy (percentage by weight) are as follows: 0.9% of Y-rich rare earth (the content of Y is above 75%), 5.9% of Zn, 0.5% of Zr, less than 0.02% of the total amount of Si, Fe, Cu and Ni as impurity elements, and the remainder of Mg.

The melt casting process for preparing an alloy is following: Firstly, Mg, Zn, Mg—Zr intermediate alloy and Mg—Ym intermediate alloy (containing Y, Er, Ho and Gd) according to the composition described above were preheated to 200~280° C., respectively. Then, Mg was placed into a crucible containing a melted flux to be melted. After Mg has been melted, Zn was added, and when the temperature of the magnesium liquid reached 720~750° C., Mg—Ym intermediate alloy was added. After Mg—Ym intermediate alloy has been melted and the temperature of the magnesium liquid rose back to 750~780° C., Mg—Zr intermediate alloy was added and then No. 6 flux was added. After refining for 15~20 min, settling for 40~50 min. When the temperature fell to 690~720° C., a round bar was cast using a semi-continuous casting method. The processing process for an alloy was following: the alloy obtained was treated by the solid-solution treatment under temperature of 480~510° C. for 2~3 hours. After cutting, an extrusion molding was performed at 330~380° C. to obtain a high-strength, high-toughness, weldable and deformable rare earth magnesium alloy.

The high-strength, high-toughness, weldable and deformable rare earth magnesium alloy obtained in the present example has the mechanical performances at room temperatures as follows:

Tensile strength: 368 MPa

Percentage elongation: 17.4%

EXAMPLE 8

The composition of an alloy (percentage by weight) are as follows: 0.9% of Y-rich rare earth (the content of Y is above 75%), 5.8% of Zn, 0.7% of Zr, less than 0.2% of the total amount of Si, Fe, Cu and Ni as impurity elements, and the remainder of Mg.

The melt casting process for preparing an alloy was as follows: Firstly, Mg, Zn, Mg—Zr intermediate alloy and Mg—Ym intermediate alloy (containing Y, Er, Ho and Gd) according to the composition described above were preheated to 200~280° C., respectively. Then, Mg was placed into a crucible containing a melted flux to be melted. After Mg has been melted, Zn was added, and when the temperature of the magnesium liquid reached 720~750° C., Mg—Ym intermediate alloy was added. When Mg—Ym intermediate alloy has been melted and the temperature of the magnesium liquid rose back to 750~780° C., Mg—Zr intermediate alloy was added and then No. 6 flux was added. After refining for 15~20 min, settling for 40~50 min. When the temperature fell to 690~720° C., a round bar was cast using a semi-continuous casting method. The processing process for an alloy was as follows: the alloy obtained was extrusion molded at 380~410° C. after cutting to obtain a high-strength, high-toughness, weldable and deformable rare earth magnesium alloy.

The high-strength, high-toughness, weldable and deformable rare earth magnesium alloy obtained in the present example has the mechanical performances at room temperature as follows:

Tensile strength: 359 Mpa

Percentage elongation: 17.1%

What is claimed is:

1. A high-strength, high-toughness, weldable and deformable rare earth magnesium alloy, based on the total weight of the alloy, comprised of 0.7-1.7% of yttrium-rich rare earth, 5.5-6.4% of Zn, 0.45-0.8% of Zr, less than 0.02% of the total amount of Si, Fe, Cu and Ni as impurity elements, and the remainder of Mg, wherein the yttrium-rich rare earth comprises yttrium and one or more additional rare earth elements in addition to yttrium, and wherein the one or more additional rare earth elements comprise about 6.3-25% by weight of the yttrium-rich rare earth.

2. The rare earth magnesium alloy of claim 1, wherein the one or more additional rare earth element is selected from group consisting of Er, Ho and Gd.

* * * * *